US005361874A

United States Patent [19]

Brown

[11] Patent Number: 5,361,874

[45] Date of Patent: Nov. 8, 1994

[54] CONFINED, SINGLE SHAFT WALL ELEVATOR LIFTING SYSTEM

[76] Inventor: Verbern R. Brown, 3390 NE. 17th Ave., Ocala, Fla. 34479

[21] Appl. No.: 128,589

[22] Filed: Sep. 28, 1993

[51] Int. Cl.[5] ..... B66B 7/02

[52] U.S. Cl. ..... 187/253; 187/406; 187/141

[58] Field of Search ..... 187/95, 9 R, 1 R, 6, 187/2, 7, 26, 9 E, 10; 182/141, 142, 145

[56] References Cited

U.S. PATENT DOCUMENTS

| | | | |
|---|---|---|---|
| 1,817,093 | 8/1931 | Kreider | 187/6 |
| 1,896,900 | 2/1933 | Kiesling | 187/95 |
| 2,236,019 | 3/1941 | Thompson | 187/6 |
| 2,308,210 | 1/1943 | Sahlin | 187/95 |
| 2,455,432 | 12/1948 | Martin | 187/26 |
| 3,878,916 | 4/1975 | White, Jr. | 182/145 |
| 3,968,860 | 7/1976 | Atkey | 187/17 |
| 4,095,677 | 6/1978 | Johannson | 187/17 |
| 4,503,936 | 3/1985 | Rice | 187/9 R |
| 4,664,230 | 5/1987 | Olsen | 187/39 |
| 4,797,055 | 1/1989 | Tworoger et al. | 414/283 |
| 5,020,641 | 6/1991 | Olsen et al. | 187/95 |

*Primary Examiner*—Kenneth W. Noland

*Attorney, Agent, or Firm*—Bell, Seltzer, Park & Gibson

[57] ABSTRACT

An elevator system includes an elevator support for supporting an elevator cab, a pair of elevator support rails, a hydraulic jack having a piston, and a sheave mechanically coupled to the piston to form a piston-sheave assembly. The elevator support rails have opposing guide members on opposite sides thereof and extending therefrom. A first pair of opposing guide members face away from each other and extend outwardly away from their respective elevator rail. A second pair of opposing guide members face each other and extend inwardly away from their respective elevator rail. An engaging system permits the travelling of both the elevator support and the piston-sheave assembly on the guide members of the elevator support rails. A cable is operatively connected to the elevator support, the sheave, and a fixed reference, such that the hydraulic jack and the sheave are confined between the opposing ends of the elevator rails during operation of the elevator.

12 Claims, 2 Drawing Sheets

CONFINED, SINGLE SHAFT WALL ELEVATOR LIFTING SYSTEM

FIELD OF THE INVENTION

This invention relates to elevators, and more particularly to elevator lifting systems and rails therefor.

BACKGROUND OF THE INVENTION

Conventional commercial elevators travel in an elevator shaft between two elevator rails and therefore require a shaft of precise dimensions. Requiring a precision shaft to carry two rails, each on an opposing wall, is not an obstacle in the commercial market since commercial construction standards are generally more exacting. Typical commercial elevator rails have a "T" shape with the vertical base of the "T" extending into the shaft. The elevator cab is then attached to the rails with rail guides, rollers, or a slide mechanism made, for example, from a TEFLON-type product. An example of a hydraulic elevator that travels between two T-shaped elevator rails in a shaft is disclosed in U.S. Pat. No. 3,968,860 to Atkey.

The conventional residential elevator, on the other hand, typically travels on a set of commercial T-shaped elevator rails which are disposed on the same wall of the elevator shaft. By placing both rails on which the elevator travels on one shaft wall, a home elevator does not demand precise shaft dimensions. Instead of using a slide mechanism, however, known residential elevators use sets of specially hardened polyurethane-type rollers which have internal bearings. Unfortunately, the commercial T-shaped rails are quite expensive to make and are costly to ship. In addition, the commercial rails are often tedious to align in a home environment. The multiple rollers used by residential elevators also increase the cost.

Besides the problems associated with T-shaped elevator rails, two other characteristics of conventional home elevators also present serious handicaps. The first, is the mounting of a sheave or other lifting aid above the uppermost end of the pair of elevator rails. For example, U.S. Pat. No. 4,664,230 to Olsen illustrates a residential elevator with its power unit and associated lifting gear permanently mounted on the uppermost end of a pair of elevator rails above the cab of the elevator. Thus, a home whose upper story does not have clearance for both an elevator cab and a sheave or other motor assembly mounted above the elevator cab would be unable to accommodate such a residential elevator.

The second detrimental characteristic of residential elevators involves the practice of burying the piston assembly for an elevator's hydraulic jack. For example, U.S. Pat. No. 5,020,641, to Olsen et al., and U.S. Pat. No. 3,968,860, to Atkey, both illustrate the burial of their respective hydraulic cylinders. As shown in both patents, for every foot the elevator travels up, there must be a corresponding foot for the piston to travel down. Because the elevator cab rides on the piston, there is no need for a sheave or motor assembly on the uppermost ends of the pair of elevator rails. However, prior to installation of the elevator, a hole must be drilled to accept a hydraulic chamber and piston. The drilling process adds to installation costs and time, and is particularly difficult where rock or coral must be penetrated.

SUMMARY OF THE INVENTION

It is therefore an object of the invention to provide an elevator system that is quickly and easily installed.

It is a further object of the invention to provide an improved elevator lifting system which is particularly suitable for residential use.

These and other objects according to the invention are provided by an elevator system which includes an elevator support, commonly known as a sling, for supporting an elevator cab, a pair of elevator support rails, a hydraulic jack having a piston, and a sheave mechanically coupled to the piston to form a piston-sheave assembly. A cable is operatively connected to the elevator support, the sheave, and a fixed reference, such that no portion of the hydraulic jack or the sheave needs to be below the bottom or above the top of the elevator support rails when the elevator is in operation. In other words, the hydraulic jack and the sheave are confined between the opposing ends of the elevator rails during operation of the elevator.

The elevator support rails are adapted for mounting on a single elevator shaft wall. The elevator support rails preferably have an "L" shaped cross-section with a first leg of each rail coupled to an elevator shaft wall and a second leg directed toward the nearest non-supporting elevator shaft wall. The second legs of a pair of elevator rails serve as a first pair of opposing guide members and are directed outwardly. Each elevator support rail also has a longitudinal guide member mounted on the inner segment of the first leg. The longitudinal guide members of a pair of elevator support rails operate as a second pair of opposing guide members and are directed inwardly. Accordingly, each pair of elevator support rails defines two pairs of opposing guide members on opposite sides thereof and extending therefrom. The first pair of opposing guide members face away from each other and extend outwardly away from their respective elevator rail. The second pair of opposing guide members face each other and extend inwardly away from their respective elevator rail.

An engaging system permits both the elevator support and the piston-sheave assembly to travel on the elevator support rails. The engaging system is preferably a first pair of slides and a second pair of slides, with each slide having a channel therein. The first pair of slides is mounted with their channels facing toward each other and is situated between the elevator support and the pair of elevator support rails. The outwardly extending opposing guide member of each of the elevator support rails is received within the inwardly directed channels of each of the first pair of slides. The first pair of slides thereby permits the elevator support to travel on the elevator support rails.

The second pair of slides also has channels therein and is similarly situated. However, the channels of the second pair of slides face away from each other so as to allow the inwardly extending opposing guide member of each of the elevator support rails to be received within each of the second pair of slides. The second pair of slides is situated between the piston-sheave assembly and the pair of elevator support rails and thereby permits the piston-sheave assembly to travel on the elevator support rails.

DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should non be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
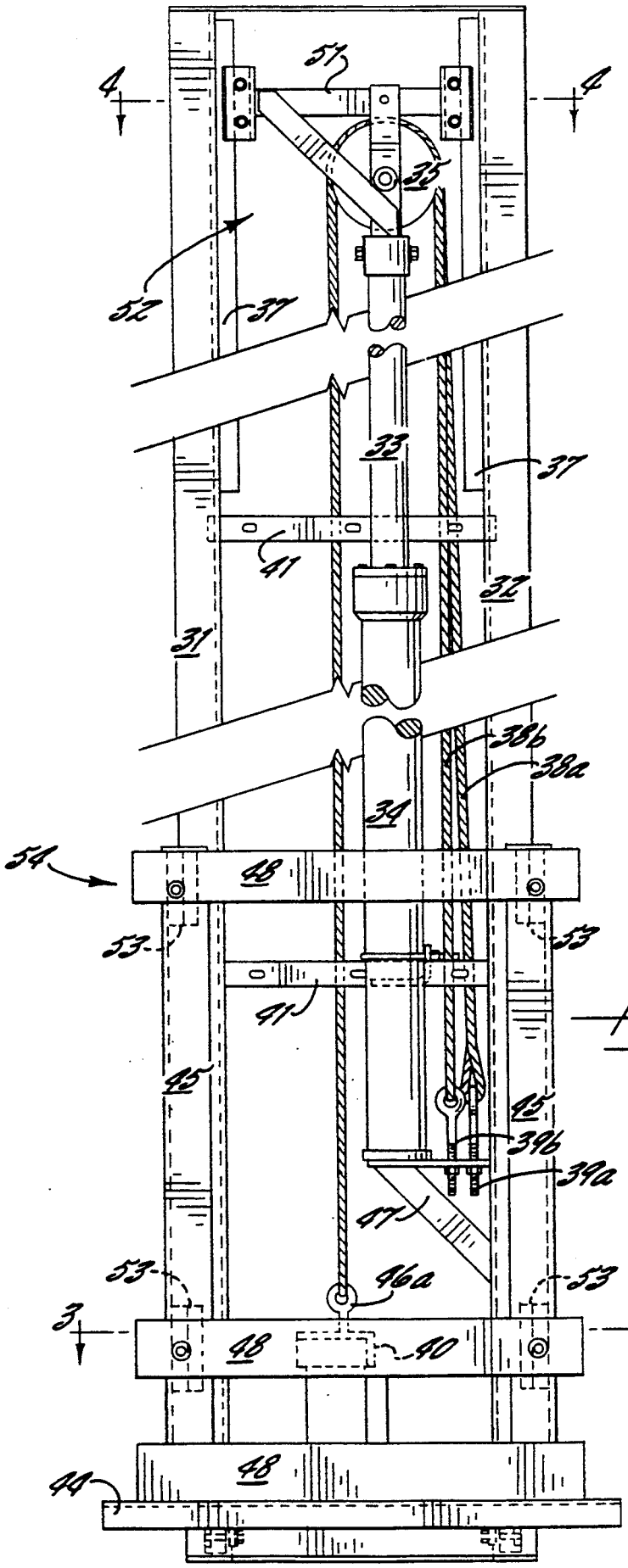
FIG. 1 is a partial front plan view of an elevator system according to the present invention.

Referring to FIG. 1, the invention is an easy to, install elevator system 30 which uses elevator support rails 31, 32 on which an elevator sling 54 and a piston-sheave assembly 52 travel. FIG. 1 shows a pair of L-shaped elevator support "angle iron" rails 31, 32 which are secured to an elevator shaft wall by a series of attachment brackets 41, with the first leg 31*a*, 32*a* of the "L" facing towards the supporting shaft wall, as shown most clearly in FIG. 3. Thus, the first leg of each L-rail 31*a*, 32*a* points into the supporting wall of the elevator shaft, and a second leg 31*b*, 32*b* of each L-rail 31, 32 points towards the nearest non-supporting elevator shaft wall and serves as a guide member. The second legs 31*b*, 32*b* of a pair of elevator support rails 31, 32 operate as a first pair of opposing guide members.

Referring again to FIG. 1, the elevator support rails 31, 32 also have a longitudinal guide member 37 mounted on the inside of their first legs 31*a*, 32*a*. The longitudinal element 37 is preferably cold rolled steel welded to an interior portion of the elevator support rails 31, 32. Thus, the longitudinal guide members 37 of a pair of elevator support rails 31, 32 operate as a second pair of opposing guide members. Accordingly, each elevator support rail 31, 32 has opposing guide members on opposite sides thereof and extending therefrom.

A hydraulic jack assembly, including a hydraulic cylinder 34 and its piston 33, is situated between the two elevator support rails 31, 32. Hydraulic jacks are well known to those having skill in the art, therefore explanation of a corresponding hydraulic fluid reservoir and pumps are omitted. A sheave 35 is mechanically coupled to the distal end of the piston 33 so that it can travel on the elevator support rails 31, 32 with the piston 33. A sheave guide 51 provides support for the piston-sheave assembly 52.

Figure 2:
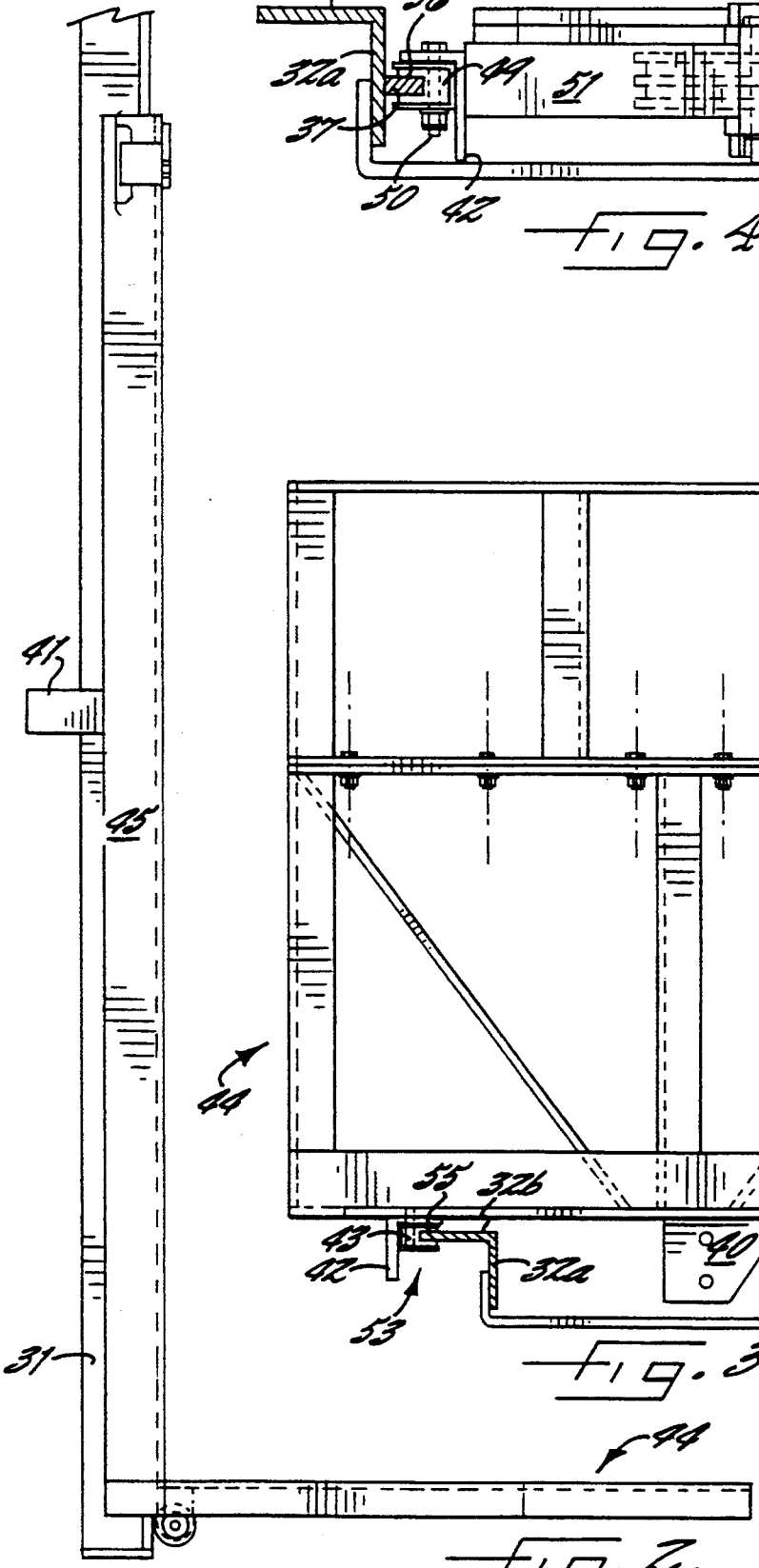
FIG. 2 is a partial side plan view of the elevator system illustrated in FIG. 1.
Figure 3:
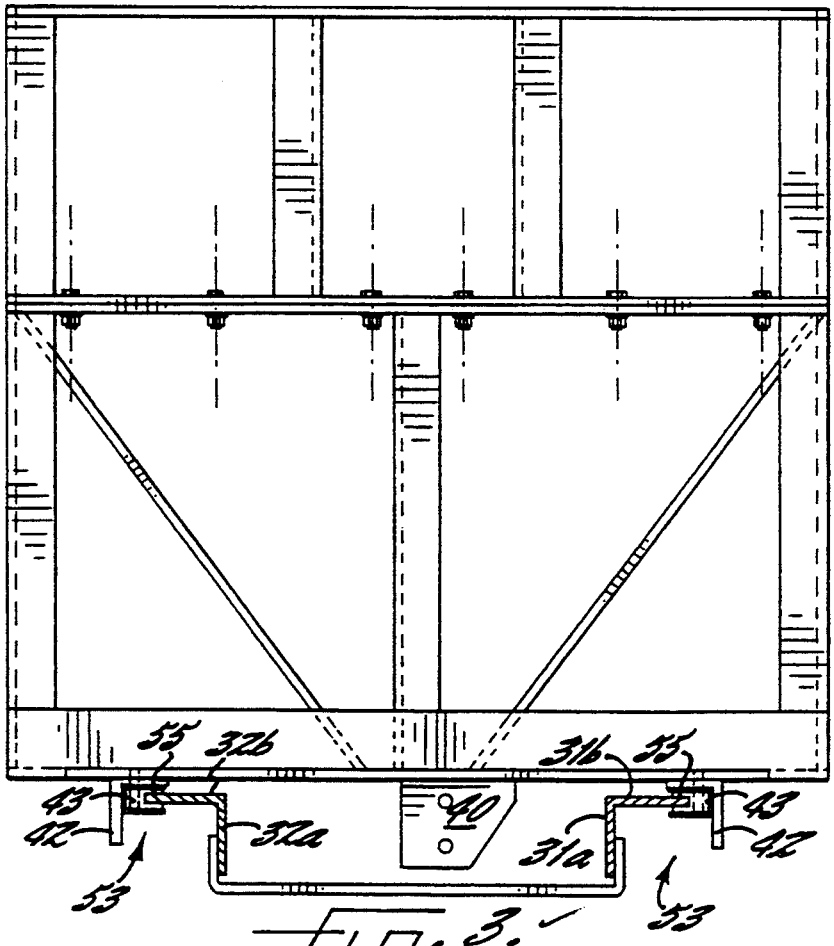
FIG. 3 is a cross-sectional view along line 3—3 of FIG. 1 and illustrates slide members according to the invention attached to an elevator support.

An elevator sling 54, commonly known as a carriage, also travels on the elevator support rails 31, 32. The elevator sling 54 is comprised of a pair of vertical support sling rails 45 connected horizontally by a group of sling crossbars 48. An elevator cab platform 44 is mechanically coupled to the elevator sling 54 and supports an elevator cab (not shown), as best shown in FIGS. 2 and 3.

Two elevator cables 38*a*, 38*b* are secured by eyebolts 39*a*, 39*b* to a fixed reference 47, known as a dead head. Although only one elevator cable is needed, a second cable serves as a backup to the first. The dead head 47 also serves as a hydraulic jack support stand for the hydraulic cylinder 34. With one end of the elevator cables 38*a*, 38*b* secured by eyebolts 39*a*, 39*b*, the cables 38*a*, 38*b* are entrained at least partially around the sheave 35 and down to another set of eyebolts 46*a*, 46*b* which are secured to a lifting plate 40 attached to a lower portion of the elevator sling 54. The sheave 35 is preferably designed with a 1:2 ratio. Thus, for every foot of piston movement, the elevator cables 38*a*, 38*b* must travel a foot around the sheave 35, thereby displacing the elevator two feet. Accordingly, the sheave guide 51 for the piston-sheave assembly 52 does not need to run the entire length of the elevator support rails 31, 32. In operation, the elevator sling 54 passes the piston-sheave assembly 52 just before the elevator sling 54 reaches the top of the shaft.

The piston-sheave assembly 52 may take on other forms without departing from the scope of the invention. For example, instead of one sheave 35 that may be approximately eight inches in diameter, one may use two smaller sheaves that are four inches in diameter and situated end on end. The two sheaves would result in the same operative relationship with the elevator sling 54 because an elevator cable would still traverse an eight inch span. Various pulley arrangements with different ratios could also be devised to arrive at the same end result.

An engaging system permits both the elevator sling 54 and the piston-sheave assembly 52 to travel on the elevator support rails 31, 32. A first engaging means 53 is coupled between the elevator sling 54 and the elevator support rails 31, 32 for permitting the elevator sling 54 to travel on the elevator support rails 31, 32. A second engaging means 36 is similarly coupled between the piston-sheave assembly 52 and the elevator support rails 31, 32 for permitting the piston-sheave assembly 52 to travel on the elevator support rails 31, 32.

Figure 4:
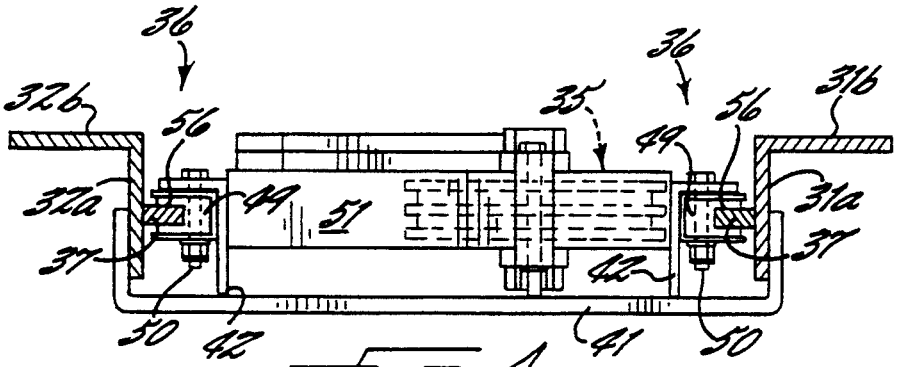
FIG. 4 is a cross-sectional view along line 4—4 of FIG. 1 and illustrates slide members according to the invention attached to a piston-sheave assembly.

The first engaging means 53 preferably comprises at least a first pair of slides 43 and the second engaging means 36 comprises a second pair of slides 49. Each slide is mechanically coupled to its respective movable element (i.e. piston-sheave assembly 52 or elevator sling 54). The mechanical coupling of each slide can include, for example, an angle iron brace 42 welded to the movable element and a nut and bolt 50. The first pair of slides 43 each have a channel 55 therein and are mounted with their channels 55 facing toward each other, as shown in FIG. 3. Thus, the second leg 31*b*, 32*b* of each of the elevator support rails 31, 32 is received within the channel 55 of each of the first pair of slides 43 and thereby permits the elevator sling 54 to travel on the elevator support rails 31, 32. In a similar fashion, the second pair of slides 49 each have a channel 56 therein, however, they are mounted with their channels 56 facing away from each other, as shown in FIG. 4. Therefore, the longitudinal guide member 37 of each of the elevator support rails 31, 32 is received within each of the second pair of slides and thereby permits the piston-sheave assembly 52 to travel on the elevator support rails 31, 32. The grooved slides are preferably of a TEFLON-type material for providing solid support and a smooth ride.

As a result of the operative relationship between the elevator sling 54 and the movable piston-sheave assembly 52, neither the hydraulic cylinder 34, its piston 33, nor the sheave 35 needs to extend below the bottom or above the top of the elevator support rails 31, 32. Accordingly, the hydraulic jack and the sheave are confined between the opposing ends of the elevator support rails 31, 32 during operation of the elevator system.

Another repercussion of the overall design is the L-shape of the elevator support rails 31, 32 which permits the purchase of generic angle iron by a builder. By purchasing angle iron rails instead of T-shaped rails, a builder saves a significant amount in the initial price and a significant amount in shipping, because the generic rails can be purchased from many more locations. In addition, the welding of the longitudinal guide members 37 onto the elevator support rails 31, 32 is quick and relatively uncomplicated.

An additional advantage of using L-shaped rails is that they are far easier to align and install than conventional T rails. The preferable method of construction involves aligning a pair of ten foot angle iron support rails 31, 32 and then welding them together as a united elevator rail section with attachment brackets 41. The hydraulic cylinder 34 and the piston-sheave assembly 52 are preferably mounted between a pair of support rails 31, 32 after the rail sections are welded together. The ten foot sections of support rails 31, 32 are then brought to the job site and aligned and plumbed as a unit. The whole installation process for an elevator system according to the invention may take approximately five hours. In contrast, the conventional T-shaped rails are aligned and plumbed individually at the job site, which is far more complicated and time consuming. The installation process for a conventional elevator system using T rails may take approximately thirty hours.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. An elevator system comprising:

an elevator cab;

elevator supporting means for supporting said elevator cab;

a pair of fixedly mounted elevator support rails;

a piston-sheave assembly operatively coupled to raise and lower said elevator supporting means on said pair of fixedly mounted elevator support rails;

first engaging means, coupled between said elevator supporting means and said pair of fixedly mounted elevator support rails, for permitting the elevator supporting means to travel on said fixedly mounted elevator support rails; and second engaging means, coupled between said piston-sheave assembly and said pair of fixedly mounted elevator support rails, for permitting the piston-sheave assembly to travel on said fixedly mounted elevator support rails.

2. An elevator system according to claim 1 wherein said pair of fixedly mounted elevator support rails are fixedly mounted on a single wall of an elevator shaft.

3. An elevator system according to claim 1 wherein said first engaging means comprises a first pair of slides and wherein said second engaging means comprises a second pair of slides.

4. An elevator system according to claim 1 wherein said pair of fixedly mounted elevator support rails each have opposing guide members on opposite sides thereof and extending therefrom.

5. An elevator system according to claim 1 wherein said piston-sheave assembly comprises:

a hydraulic jack having a piston;

a sheave mechanically coupled to said piston; and a cable operatively connected to said elevator supporting means, said sheave, and a fixed reference.

6. An elevator system comprising:

an elevator cab;

elevator supporting means for supporting said elevator cab;

a pair of fixedly mounted elevator support rails;

a piston-sheave assembly operatively coupled to raise and lower said elevator supporting means on said pair of fixedly mounted elevator support rails;

first engaging means, coupled between said elevator supporting means and said pair of fixedly mounted elevator support rails, for permitting the elevator supporting means to travel on said fixedly mounted elevator support rails; and second engaging means, coupled between said piston-sheave assembly and said pair of fixedly mounted elevator support rails, for permitting the piston-sheave assembly to travel on said fixedly mounted elevator support rails;

wherein said pair of fixedly mounted elevator support rails each have opposing guide members on opposite sides thereof and extending therefrom; and wherein said first engaging means comprises a first pair of slides and said second engaging means comprises a second pair of slides, said first pair of slides each having a channel therein, said first pair of slides being mounted with said channels facing toward each other so as to allow an opposing guide member of each of said fixedly mounted elevator support rails to be received within each of said first pair of slides and thereby permit the elevator supporting means to travel on said fixedly mounted elevator support rails, and wherein said second pair of slides each have a channel therein, said second pair of slides being mounted with said channels facing away from each other so as to allow an opposing guide member of each of said fixedly mounted elevator support rails to be received within each of said second pair of slides and thereby permit the piston-sheave assembly to travel on said fixedly mounted elevator support rails.

7. An elevator system comprising:

an elevator cab;

elevator supporting means for supporting said elevator cab;

a pair of fixedly mounted elevator support rails;

a piston-sheave assembly operatively coupled to raise and lower said elevator supporting means on said pair of fixedly mounted elevator support rails;

first engaging means, coupled between said elevator supporting means and said pair of fixedly mounted elevator support rails, for permitting the elevator supporting means to travel on said fixedly mounted elevator support rails; and second engaging means, coupled between said piston-sheave assembly and said pair of fixedly mounted elevator support rails, for permitting the piston-sheave assembly to travel on said fixedly mounted elevator support rails;

wherein said pair of fixedly mounted elevator support rails include first and second legs which define an "L" shaped cross-section, said first leg of each of the rails adapted to be coupled to an elevator shaft support wall such that said second leg of each of the fixedly mounted elevator support rails is directed toward the nearest non-supporting elevator shaft wall and can operate as a guide member, wherein the second legs of a pair of fixedly mounted elevator support rails operate as a pair of opposing guide members.

8. An elevator system according to claim 7 further comprising a pair of longitudinal guide members respectively mounted on each first leg of said pair of fixedly mounted elevator support rails, the longitudinal guide members of the pair of fixedly mounted elevator support rails defining a second pair of opposing guide members such that a pair of elevator support rails each have opposing guide members on opposite sides thereof and extending therefrom.

9. An elevator system comprising:

an elevator cab;

elevator supporting means for supporting said elevator cab;

a pair of fixedly mounted elevator support rails each having a pair of opposing ends;

a hydraulic jack having a piston;

a sheave mechanically coupled to the piston to form a piston-sheave assembly, said piston-sheave assembly being operatively coupled to raise and lower said elevator supporting means on said pair of fixedly mounted elevator support rails; and engaging means for permitting the elevator supporting means to travel on said fixedly mounted elevator support rails and for permitting the piston-sheave assembly to travel on said fixed mounted elevator support rails such that said hydraulic jack and said sheave are confined between said pairs of opposing ends during operation of said piston-sheave assembly.

10. An elevator system according to claim 9 wherein said engaging means comprises a first pair of slides mounted between said elevator supporting means and said fixedly mounted elevator supporting a second pair of slides mounted between said piston sheave-assembly and said fixedly mounted elevator support rails.

11. An elevator system according to claim 9 wherein said pair of fixedly mounted elevator support rails each have opposing guide members on opposite sides thereof and extending therefrom.

12. An elevator system comprising:

an elevator cab;

elevator supporting means for supporting said elevator cab;

a pair of fixedly mounted elevator support rails each having a pair of opposing ends;

a hydraulic jack having a piston;

a sheave mechanically coupled to the piston to form a piston-sheave assembly, said piston-sheave assembly being operatively coupled to raise and lower said elevator supporting means on said pair of fixedly mounted elevator support rails; and engaging means for permitting the elevator supporting means to travel on said fixedly mounted elevator support rails and for permitting the piston-sheave assembly to travel on said fixed mounted elevator support rails such that said hydraulic jack and said sheave are confined between said pairs of opposing ends during operation of said piston-sheave assembly;

wherein said pair of fixed mounted elevator support rails each have opposing guide members on opposite sides thereof and extending therefrom; and wherein said engaging means comprises:

a first pair of slides, coupled between said elevator supporting means and said pair of fixedly mounted elevator support rails, each slide having a channel therein and wherein said first pair of slides are mounted with said channels facing toward each other so as to allow an opposing guide member of each of said elevator support rails to be received within each of said first pair of slides and thereby permit the fixedly mounted elevator supporting means to travel on said elevator support rails; and a second pair of slides, coupled between said piston-sheave assembly and said pair of fixedly mounted elevator support rails, each slide having a channel therein and wherein said first pair of slides are mounted with said channels facing away from each other so as to allow an opposing guide member of each of said elevator support rails to be received within each of said second pair of slides and thereby permit the piston-sheave assembly to travel on said fixedly mounted elevator support rails.

* * * * *